United States Patent [19]

Takahashi

[11] Patent Number: 4,667,493

[45] Date of Patent: May 26, 1987

[54] DISC TYPE CYLINDER LOCK

[75] Inventor: Hiroyuki Takahashi, Tokyo, Japan

[73] Assignee: Takigen Manufacturing Co. Ltd., Tokyo, Japan

[21] Appl. No.: 833,160

[22] Filed: Feb. 27, 1986

[30] Foreign Application Priority Data

Mar. 9, 1985 [JP] Japan ..... 60-46739
Mar. 9, 1985 [JP] Japan ..... 60-46740

[51] Int. Cl.[4] ..... E05B 27/00
[52] U.S. Cl. ..... 70/366; 70/377
[58] Field of Search ..... 70/365, 366, 367, 389, 70/392, 421

[56] References Cited

U.S. PATENT DOCUMENTS

| | | | |
|---|---|---|---|
| 2,217,047 | 9/1940 | Fitzgerald | 70/366 |
| 2,862,380 | 12/1958 | Welch | 70/366 |
| 4,317,347 | 3/1982 | Martikainen et al. | 70/377 X |

FOREIGN PATENT DOCUMENTS

| | | | |
|---|---|---|---|
| 1914776 | 10/1969 | Fed. Rep. of Germany | 70/366 |
| 2245729 | 4/1974 | Fed. Rep. of Germany | 70/366 |
| 2251691 | 7/1975 | France | 70/366 |
| 450017 | 4/1975 | U.S.S.R. | 70/366 |

*Primary Examiner*—Carl D. Friedman
*Assistant Examiner*—Naoko N. Slack
*Attorney, Agent, or Firm*—Martin Smolowitz

[57] ABSTRACT

A disc type cylinder lock comprises an outer cylinder; an inner cylinder fitted in the outer cylinder; locking tumbler discs inserted in the inner cylinder; a positioning disc slightly movable within inner cylinder; a key insertable into key-holes of the locking tumbler discs and the positioning disc; and a side bar disposed between the outer cylinder and the peripheries of the locking tumbler discs and the positioning disc. The positioning disc has a protrudent piece which is able to enter and escape from a receiving hole formed in the inner cylinder. The key-hole of the positioning disc is longer in a radial direction than the key-holes of the locking tumbler discs. The positioning disc has a projection on the periphery of the key-hole. The key has a longitudinal guide groove and a recess at the terminal of the guide groove. When the key is initially after full insertion thereof, a through-groove is formed by aligned notches of the locking tumbler discs and the positioning disc. Upon the further rotation of the key, the side bar enters into the through-groove, thereby the projection of the positioning disc enters into said recess of the key, and the protrudent piece of the positioning disc escapes from the receiving hole of the inner cylinder. In this way, the inner cylinder can rotate to a predetermined extent with respect to the outer cylinder.

2 Claims, 15 Drawing Figures

DISC TYPE CYLINDER LOCK

BACKGROUND OF THE INVENTION

1. Field of the Invention

The present invention relates to a disc type cylinder lock which is capable of effecting locking and unlocking operations of an equipment such as a door and the like without any anxiety, in which a key is pulled out by reversing locking tumbler discs that are at an incompletely unlocked position.

2. Description of the Prior Art

In a disc type cylinder lock of the prior art, as disclosed in U.S. Pat. No. 2,217,047 and U.S. Pat. No. 2,862,380, discs inserted into an inner cylinder are only locking tumbler discs which only perform locking and unlocking operations relative to inner and outer cylinders.

However, such a disc arrangement cannot prevent the key from rotating in a state where insertion of the key is not yet accomplished, and consequently the innermost locking tumbler disc may be left in a non-rotated position. For this reason, a through-groove is never formed at peripheries of all of the locking tumbler discs, so that a side bar cannot move toward the inner cylinder, whereby the inner cylinder cannot be unlocked with respect to the outer cylinder. In such a situation of incomplete unlocking, as the key is unable to further rotate, an operator is liable to make a misunderstanding that the unlocking operation is finished, and then the operator may undesirably pull out the key by reversely rotating the locking tumbler discs.

If the key is pulled out in a state where key-holes of the locking tumbler discs are never aligned with each other, at the next time of key insertion, the tip of the key is likely to impinge upon one or more locking tumbler discs not rotated at the first operation. In this instance, in order to completely insert the key up to the innermost locking tumbler disc, the operator must shake the key at anytime when encountering such an impingement condition, so that it is impossible to get a smooth locking operation.

On the other hand, in a detent mechanism of the prior art, an inner cylinder provided with a radial hole in its rear end portion. A small detent ball and a compression coil spring are inserted into said radial hole. The detent ball engages with one of two recessions formed in the peripheral surface of an outer cylinder, when the inner cylinder is rotated to the unlocking position or the locking position. It is necessary to provide a surplus space for an exclusive use of the detent mechanism.

SUMMARY OF THE INVENTION

Accordingly, it is a primary object of the present invention to provide an improved disc type cylinder lock wherein a positioning disc is fitted in an inner cylinder in addition to conventional locking tumbler discs, so that all of the locking tumbler discs can not be rotated unless the key is completely inserted.

Another object of the present invention is to provide an improved disc type cylinder lock which does not need any surplus space for an exclusive use of an additional detent mechanism.

Other objects and advantages of the invention will become apparent from the following description with reference to the accompanying drawings.

BRIEF DESCRIPTION OF THE DRAWINGS

The drawings in combination show one embodiment of the present invention.

DESCRIPTION OF THE PREFERRED EMBODIMENT

Figure 1:
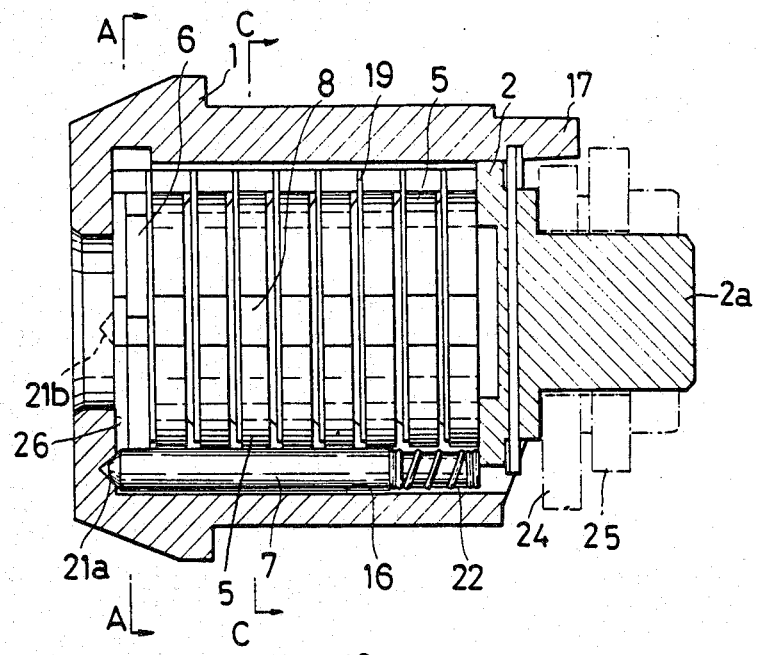
FIG. 1 is an assembly view of a disc type cylinder lock, an inner cylinder and an outer cylinder which are shown in vertical section.
Figure 2:
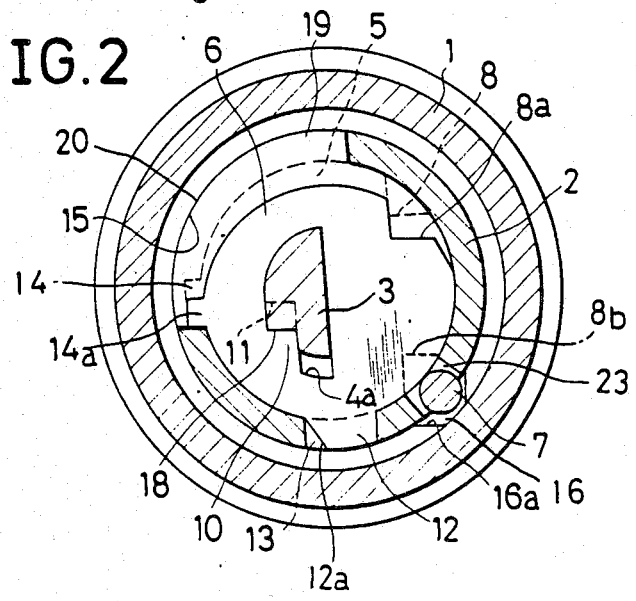
FIG. 2 is a sectional view taken along the line A—A in FIG. 1 when a key is completely inserted in the inner cylinder to a predetermined length.
Figure 3:
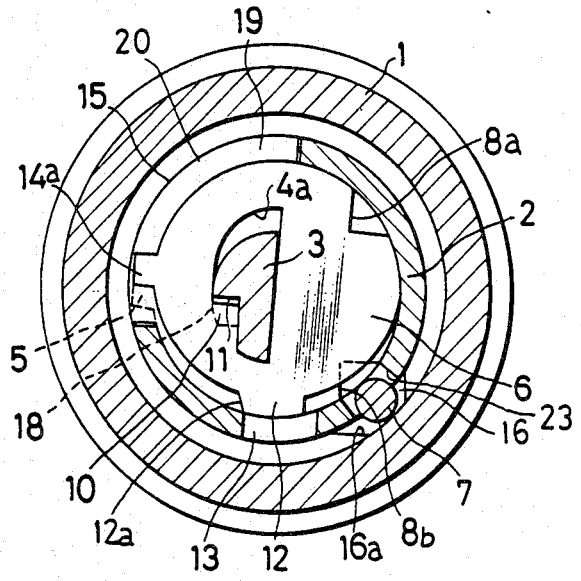
FIG. 3 is a sectional view corresponding to FIG. 2 when a protrudent piece of a positioning disc escapes from a receiving hole of the inner cylinder.
Figure 4:
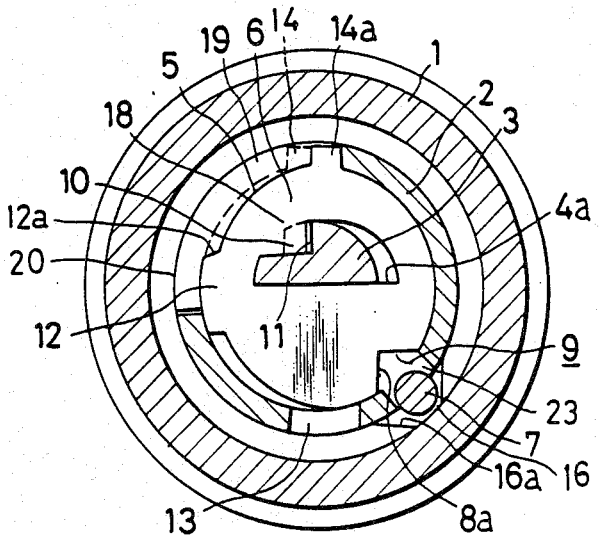
FIG. 4 is a sectional view corresponding to FIG. 2 when a through-groove formed by notches of locking tumbler discs and the positioning disc is brought to a position facing on a side bar.
Figure 5:
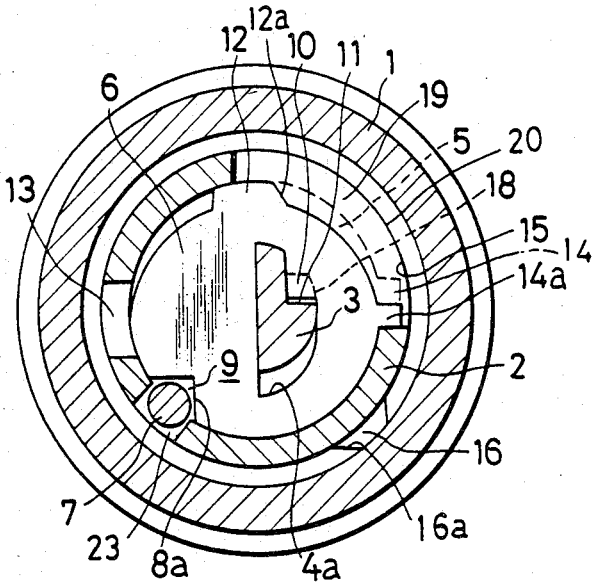
FIG. 5 is a sectional view corresponding to FIG. 2 when said side bar is entered into said through-groove so as to unlock said inner cylinder with respect to said outer cylinder.
Figure 6:
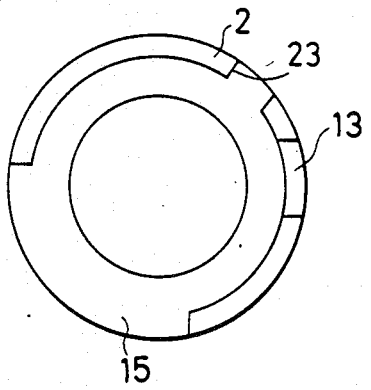
FIG. 6 is a front view of the inner cylinder incorporated into said cylinder lock.
Figure 7:
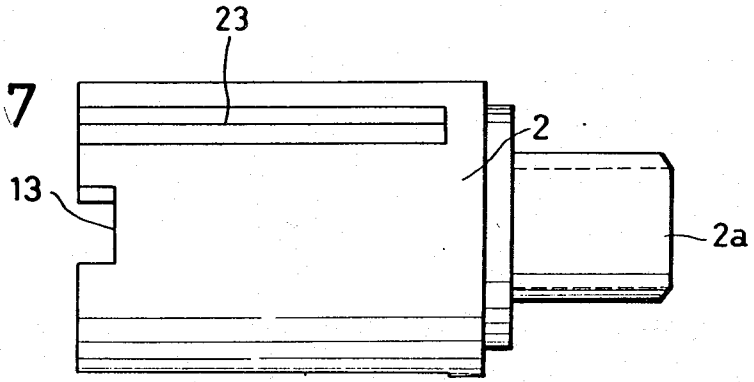
FIG. 7 is a right side view of said inner cylinder.
Figure 8:
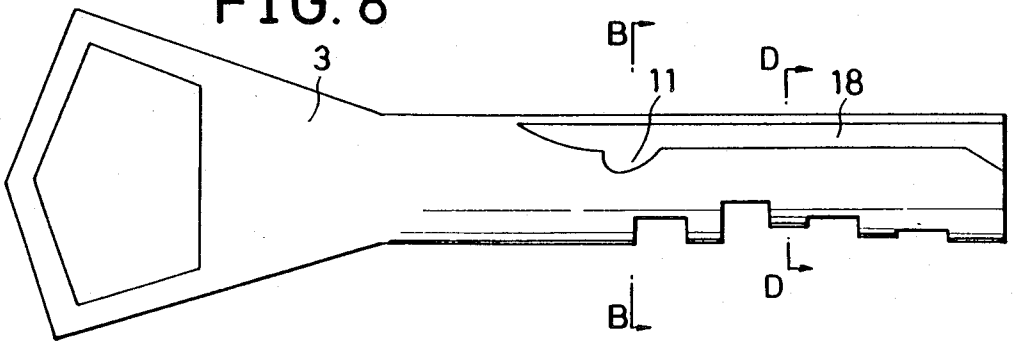
FIG. 8 is a right side view of a key to be used for said cylinder lock.
Figure 9:
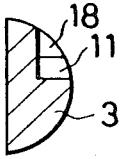
FIG. 9 is a sectional view taken along the line B—B in FIG. 8.
Figure 10:
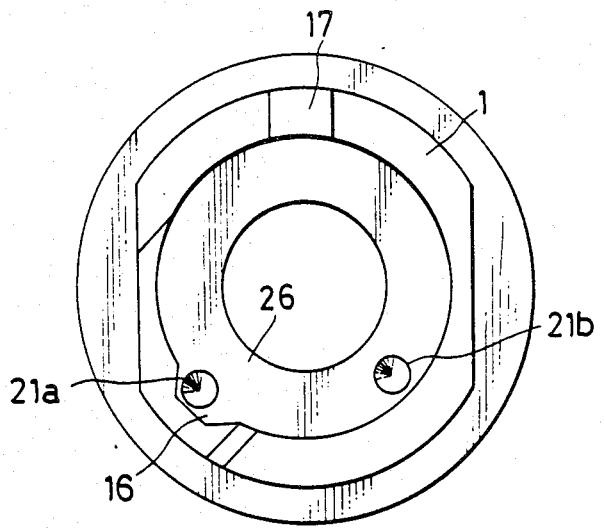
FIG. 10 is a rear view of the outer cylinder incorporated into said cylinder lock.
Figure 11:
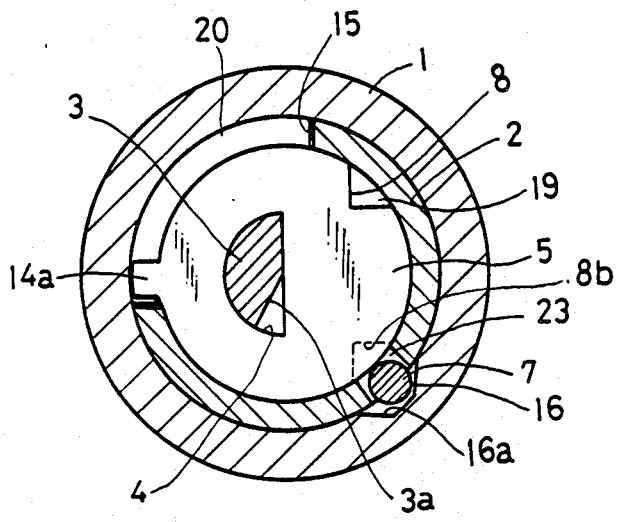
FIG. 11 is a sectional view taken along the line C—C in FIG. 1 which shows the locking tumbler disc.
Figure 12:
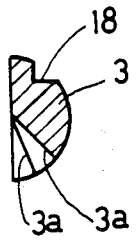
FIG. 12 is a sectional view taken along the line D—D in FIG. 8 wich shows key surface for pushing the discs.
Figure 13:
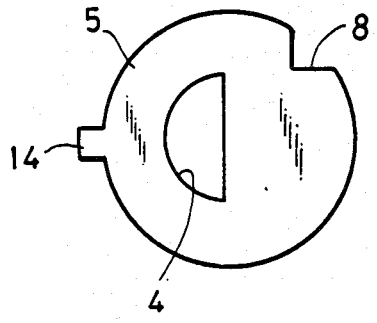
FIG. 13 is a front view of one of the locking tumbler discs incorporated into said cylinder lock.
Figure 14:
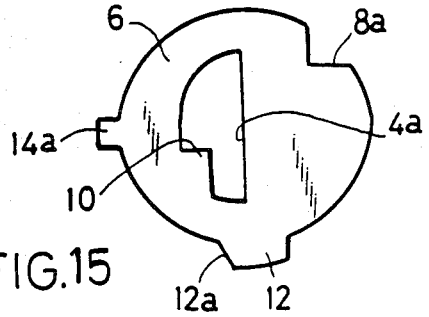
FIG. 14 is a front view of the positioning disc incorporated into said cylinder lock.
Figure 15:
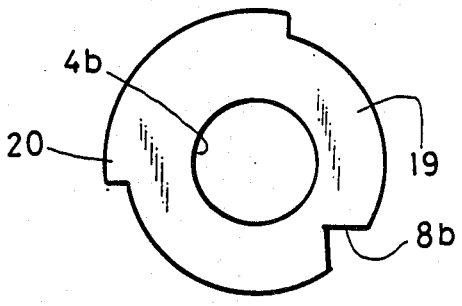
FIG. 15 is a front view of a spacer plate incorporated into said cylinder lock.

The present invention will be described hereinafter with reference to the accompanying drawings.

A disc type cylinder lock according to the present invention comprises an outer cylinder 1 having a side bar receiving groove 16 in the inner surface thereof, an inner cylinder 2 fitted in said outer cylinder 1, a plurality of locking tumbler discs 5 inserted in said inner cylinder 2, a positioning disc 6 inserted into said inner cylinder 2, a side bar 7 disposed between the inner cylinder 2 and the outer cylinder 1, and a key 3 to be inserted into both key-holes 4 of said locking tumbler discs 5 and another key-hole **4*a* of said positioning disc 6. The key-holes 4 and 4*a*** have substantially semicircular shape.

The locking tumbler discs 5 have a notch 8 in a periphery thereof, and said positioning disc has also a notch **8*a* in a periphery thereof. The positioning disc 6 is smaller than the locking tumble discs 5, so that it can move in a radial direction within said inner cylinder 2. The side bar receiving groove 16 has a slanted cam surface 16*a*. When a rotational force is given to the inner cylinder 2 by the key 3, the side bar 7 abuts on the cam surface, and thereby the side bar 7 is moved in a radial direction through a longitudinal groove 23 formed in the inner cylinder 2**.

The key-hole 4*a* of the positioning disc 6 is longer in a radial direction than said key-hole 4 of the locking tumbler disc 5. The key 3 of semicircular section is provided with a plurality of key surfaces 3*a* on its side edge. The key surfaces 3*a* push the straight portions of the key-hole 4 and 4*a* respectively, when the key is rotated after the complete insertion thereof.

A protrudent piece 12 is provided on a periphery of said positioning disc 6. The protrudent piece 12 is able to enter into a protrudent piece receiving hole 13 formed in a periphery of said inner cylinder 2. The protrudent piece 12 has a slanted surface 12*a*, which abutts on an edge of the receiving hole 13 when a rotational force is given to the positioning disc 6 by the key 3.

A projecting length of said protrudent piece 12 is equivalent to a longitudinal difference between said key-hole 4 and said key-hole 4*a*. A projection 10 is formed on a periphery of said key-hole 4*a* of the positioning disc 6. The key 3 is provided with a guide groove 18 on a side surface which extends longitudinally from the tip thereof. Said projection 10 passes through the recess 18, when the key 3 is inserted into said key-hole 4*a*. The guide groove 18 has a a recess 11 at its terminal in which said projection 10 is engageable.

Spacer plates 19 are interposed between the positioning disc 6 and the locking tumbler discs 5, and also between each of the locking tumbler discs 5, 5. The spacer plates 19 prevent attendant movements produced among the locking tumbler discs 5. Each spacer plate 19 is provided with a stopper protrusion 20 on its periphery, which is engaged with a side opening 15 formed in the inner cylinder 2 so as to prevent rotation of the spacer plate 19 with respect to the inner cylinder 2. Each spacer plate 19 is provided with a notch 8*b* similar to said notches 8 and 8*a* on its periphery. The notch 8*b* always communicates with said longitudinal opening 23 of the inner cylinder 2. The spacer plate 19 has a key-hole 4*b* of circular shape.

In the above disc type cylinder lock, when said key 3 is completely inserted, said projection 10 of the positioning disc 6 is brought to the position facing on said recess 11 of the key 3. Upon the initial rotation of the key 3 after such full insertion, said positioning disc 6 moves slightly in a radial direction through said longitudinal opening 23 of the inner cylinder 2. Thereby said projection 10 of the positioning disc 6 fits in said recess 11 of the key 3 and said protrudent piece 12 escapes from said receiving hole 13 of the inner cylinder, 2 such that the positioning disc 6 is entirely withdrawn into the inner cylinder 2.

When the key 3 is further rotated, said locking tumbler discs 5 and said positioning disc 6 concomitantly rotate to a respectively predetermined extent with respect to the inner cylinder 2, thereby said notches 8 of the locking tumbler discs 5 and said notch 8*a* of the positioning disc 6 are aligned to said notch 8*b* of the spacer plate 19 so as to form a through-groove 9 which communicates with said longitudinal opening 23 of the inner cylinder 2.

A projecting portion 14 of the locking tumbler disc 5 and a projecting portion 14*a* of the positioning disc 6 can move within said side opening 15 of the inner cylinder 2, and they determine the rotation extent of said discs 5 and 6 respectively by abutting on side surface of said side opening 14.

When said key 3 is further rotated, said side bar 7 can escape from said groove 16 of the outer cylinder 1 and enters in to said through-groove 9, so that said inner cylinder 2 is unlocked with respect to the outer cylinder 1. Thus, the inner cylinder 2 can be rotated by the key 3. When a stopper plate 24 fixed to a tip portion 2*a* of the inner cylinder 2 abuts against a stoppage projection 17 formed on the outer cylinder 1, the inner cylinder 2 stops to rotate. At this time, a latch plate 25 fixed to said tip portion 2*a* of the inner cylinder 2 moves to an unlocking position, where it escapes from a latch plate receiver provided on a stationary member such as a box body or door jamb.

In this way, as all of the locking tumbler discs 5 cannot be rotated unless the key 3 is completely inserted, there is no probability for the key 3 to be pulled out by reversably rotating the locking tumbler discs 5 in an unsuitable situation where an unlocking operation is never completed. Accordingly, the disc type cylinder lock of the present invention can function always with good stability.

The outer cylinder 1 is provided with a front edge rim 26 on the front portion of its inner periphery, and a recession 21*a* is formed in the rear surface of the front edge rim 26. A tip of said side bar 7 is engageable with the recession 21*a*, when the side bar 7 engages with both said groove 16 of the outer cylinder 1 and said longitudinal opening 23 of the inner cylinder 2, namely, when the side bar 7 is located at the locking position.

Moreover, another recession 21*b* is formed in the rear surface of said front edge rim 26. The tip of said side bar 7 is engageable with the recession 21*b*, when the side bar 7 is brought to the unlocking position after engaging with both said through-groove 9 and the longitudinal opening 23. The side bar 7 is pushed forwards by a compression coil spring 22 which is interposed between its rear end portion of small diameter and the inner bottom surface of said inner cylinder 2.

A suitable detent mechanism is constituted by the side bar 7, the recession 21*a*, 21*b* and the coil spring 22. The detent mechanism is used for confirming terminations of the locking rotation and the unlocking rotation of said inner cylinder 2.

Namely, when said inner cylinder 2 is rotated to the unlocking position, the side bar 7 is advanced by said coil spring 22 and the tip of said side bar 7 engages with said recession 21*b*. It is feasible to confirm whether the unlocking operation is completely done or not by virtue of the clicking sound and the vibrational touch on the user's fingertips, which are produced upon said engagement of the side bar 7 and the recession 21*b*.

In the locking operation, when said inner cylinder 2 is rotated to the locking position, the side bar 7 is also advanced by said coil spring 22 and the tip of said side bar 7 engages with another recession 21*b*. It is also feasible to confirm whether the locking operation is completely done or not by means of the clicking sound and the vibrational touch on fingertips, which are produced upon said engagement of the side bar 7 and the recession 21*b*.

Because said side bar 7 acts not only as a locking member but also as a part of the detent mechanism, it is unnecessary to provide a surplus space for an exclusive use of the detent mechanism. Therefore, it is easy to reduce dimensions of the disc type cylinder lock as a whole. As the number of appropriate parts for the detent mechanism is decreased, it is also easy to reduce the production cost of the disc type cylinder lock.

What is claimed is:

1. A disc type cylinder lock comprising: an outer cylinder having a side bar receiving groove in the inner surface thereof; an inner cylinder fitted in said outer cylinder; a plurality of locking tumbler discs inserted in said inner cylinder, said locking tumbler discs each having a key-hole, each of said locking tumbler discs further having a notch in a periphery thereof; a positioning disc having a key-hole which is longer in longitudinal length than said key-hole of the locking tumbler disc, said positioning disc further having a notch in a periphery thereof; a protrudent piece provided on a periphery of said positioning disc, said protrudent piece entering and escaping from a protrudent piece receiving hole formed in a periphery of said inner cylinder, a projecting length of said protrudent piece being equivalent to the longitudinal length difference between said key-holes of the locking tumbler discs and said key-hole of the positioning disc; a projection formed on a periphery of said key-hole of the positioning disc; a side bar movable in a radial direction through a longitudinal opening formed in said inner cylinder; and a key to be inserted into both said key-holes of the locking tumbler discs and said key-hole of the positioning disc, said key having a guide groove on a side surface which extends longitudinally from the tip thereof, said guide groove having a recess at its terminus; wherein upon the rotation of said key after full insertion, said positioning disc moves in a radial direction, thereby said projection of the positioning disc fits in said recess of the key and said protrudent piece escapes from said receiving hole of the inner cylinder such that said positioning disc is entirely withdrawn into the inner cylinder, and upon the further rotation of said key, said locking tumbler discs and said positioning disc concomitantly rotate to a predetermined extent with respect to said inner cylinder, thereby said notches of the locking tumbler discs and said notch of the positioning disc are aligned so as to form a through-groove, and then said through-groove is brought to the the position whereat it communicates with said longitudinal opening of the inner cylinder, and when said key is further rotated, said side bar escapes from said groove of the outer cylinder and enters into said through-groove such that said inner cylinder can rotate to the predetermined extent with respect to said outer cylinder.

2. The disc type cylinder lock as claimed in claim 1, wherein said cylinder lock further comprises: a front edge rim formed on the front inner priphery of said outer cylinder; a recession formed in the rear surface of said front edge rim with which a tip of said side bar is engageable when the side bar engages with both said groove of the outer cylinder and said longitudinal opening of the inner cylinder, namely, when the side bar is located at the locking position; another recession formed in the rear surface of said front edge rim with which the tip of said side bar is engageable when the side bar is brought to the unlocking position after engaging with both said through-groove and the longitudinal opening; and a compression spring interposed between the rear end portion of the side bar and the inner bottom surface of said inner cylinder, said coil spring pushing said side bar forwards such that the tip of the side bar engages with one of said two recessions.

* * * * *